US005434659A

United States Patent [19]

Takarada et al.

[11] Patent Number: 5,434,659

[45] Date of Patent: Jul. 18, 1995

[54] CLEANING UNIT

[75] Inventors: Takeshi Takarada, Tenri; Kiyoshi Inamoto, Sakai; Hidetomo Nishiyama, Yamatokoriyama; Masato Tokishige, Nara; Kazuyuki Onishi, Nara; Kazunori Sohda, Nara; Masami Uchida, Kitakyushu; Tokiyuki Okano, Yamatokoriyama, all of Japan

[73] Assignee: Sharp Kabushiki Kaisha, Osaka, Japan

[21] Appl. No.: 288,423

[22] Filed: Aug. 10, 1994

Related U.S. Application Data

[63] Continuation of Ser. No. 638,500, Jan. 7, 1991, abandoned.

[30] Foreign Application Priority Data

Jan. 9, 1990 [JP] Japan ..... 2-2770

[51] Int. Cl.[6] ..... G03G 21/00

[52] U.S. Cl. ..... 355/296; 355/208; 355/275

[58] Field of Search ..... 355/296, 299, 300, 301, 355/302, 303, 305, 307, 208, 243, 311, 275, 300, 203, 281

[56] References Cited

U.S. PATENT DOCUMENTS

| | | | |
|---|---|---|---|
| 4,518,247 | 5/1985 | Nishikawa | 355/299 |
| 4,519,699 | 5/1985 | Mayer et al. | 355/301 X |
| 4,561,762 | 12/1985 | Watanabe et al. | 355/299 |
| 4,568,174 | 2/1986 | Stange | 355/300 |
| 4,745,438 | 5/1988 | Acquaviva et al. | 355/243 X |
| 4,788,572 | 11/1988 | Slayton et al. . | |
| 5,051,783 | 9/1991 | Sato | 355/296 X |
| 5,061,966 | 10/1991 | Haneda et al. | 355/296 X |
| 5,073,800 | 12/1991 | Yamaguchi et al. | 355/299 X |
| 5,196,893 | 3/1993 | Nishise et al. | 355/296 X |

*Primary Examiner*—A. T. Grimley
*Assistant Examiner*—Shuk Y. Lee
*Attorney, Agent, or Firm*—David G. Conlin; George W. Neuner; Milton Oliver

[57] ABSTRACT

A cleaning unit used for cleaning the surface of a recording medium in an image forming apparatus, the cleaning unit having a head being moved so as to contact with and separate from the recording medium on the basis of the assessment of preset image forming conditions such as paper size, document size, and copy magnification, and a control section for moving the cleaning head at a detected appropriate time, wherein the cleaning head is released so as to avoid the dispersion of toner that is likely to spoil the image.

6 Claims, 5 Drawing Sheets

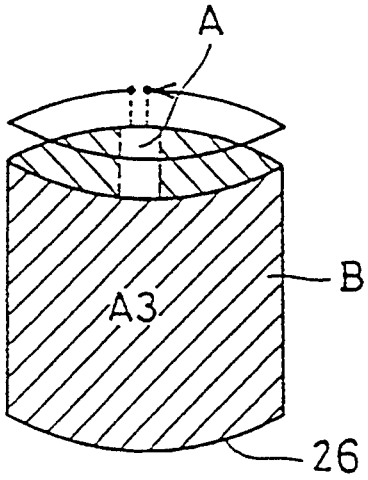
FIG. 7(a)
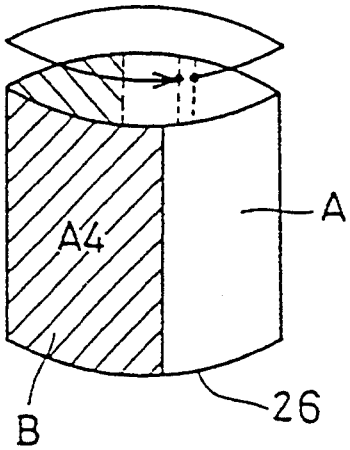
FIG. 7(b)
FIG. 8(a)
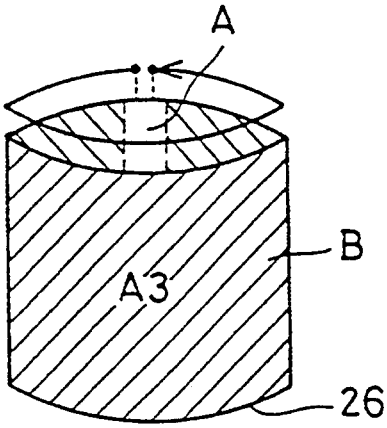
FIG. 8(b)
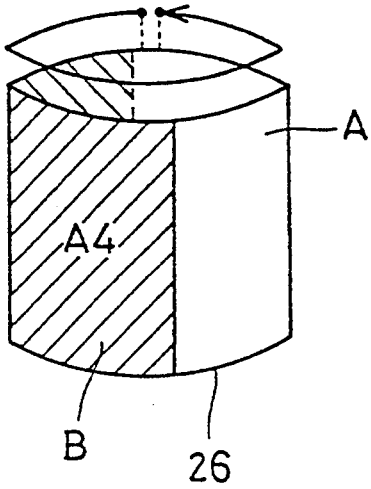

CLEANING UNIT

This is a continuation of application Ser. No. 07/638,500 filed on Jan. 7, 1991, now abandoned.

BACKGROUND OF THE INVENTION

1. Field of the Invention

The present invention relates to a cleaning unit used in an image forming apparatus, such as a copying machine or a laser printer, which uses toner for forming images.

2. Description of the Prior Art

It is generally known that a full-color copying machine is provided with a belt-like recording medium onto which toner images of different colors developed on a photosensitive material are transferred. In such a copying machine, a cleaning unit having a cleaning head for removing residual toner from the surface of the recording medium is disposed movably with respect to the recording medium.

In a conventional mono-color copying machine, since there is no need to superimpose toners of different colors onto a belt or the like, it is not necessary to provide the recording medium. The cleaning head need not be switched between two positions, that is, a contact position and a release position with respect to the recording medium.

Also, even in the case of a full-color copying machine, if the construction is such that different color images are superimposed one on top of the other directly onto the copy paper, it is not necessary to clean the recording medium.

On the other hand, in the case of a full-color copying machine which uses a recording medium, it has been a usual practice to always press and release a cleaning head with the same timing regardless of any change in the copying conditions.

In a full-color copying machine, when a cleaning head is separated from a recording medium while cleaning the recording medium to remove residual toner, there is a possibility that the toner adhering to the cleaning head may fall onto the recording medium and adversely affect the image quality.

Also, since the cleaning head is always separated from the recording medium at the same position on the recording medium regardless of any change in the copying conditions, the problem is that the toner falling off the cleaning member may be deposited onto the image area on the recording medium depending on the copying conditions, allowing the deposited toner to be transferred to the copy paper and thereby smearing the copy image.

SUMMARY OF THE INVENTION

The cleaning unit of this invention, which overcomes the above-discussed and numerous other disadvantages and deficiencies of the prior art, comprises a cleaning head for cleaning the surface of a recording medium, a moving means for moving the cleaning head to contact with and to separate from the recording medium, means for judging the preset image forming conditions, and a control means for actuating the moving means at an appropriate time on the basis of the preset conditions detected by the judging means.

In a preferred embodiment, the cleaning head is released from the recording medium on the basis of the paper size.

In a preferred embodiment, the cleaning head is released from the recording medium on the basis of the present paper size and the preset copying magnification.

Thus, the invention described herein makes possible the objective of providing a cleaning unit capable of releasing the cleaning head according to a paper size, document size, and other copying conditions, so as to avoid staining the copy paper with dispersed toner.

BRIEF DESCRIPTION OF THE DRAWINGS

This invention may be better understood and its numerous objects and advantages will become apparent to those skilled in the art by reference to the accompanying drawings as follows:

FIGS. 7(*a*) and 7(*b*) are diagrams showing the operating areas of the cleaning head on the recording medium; and FIGS. 8(*a*) and 8(*b*) are diagrams showing the same according to a prior art method.

DESCRIPTION OF THE PREFERRED EMBODIMENTS

Figure 4:
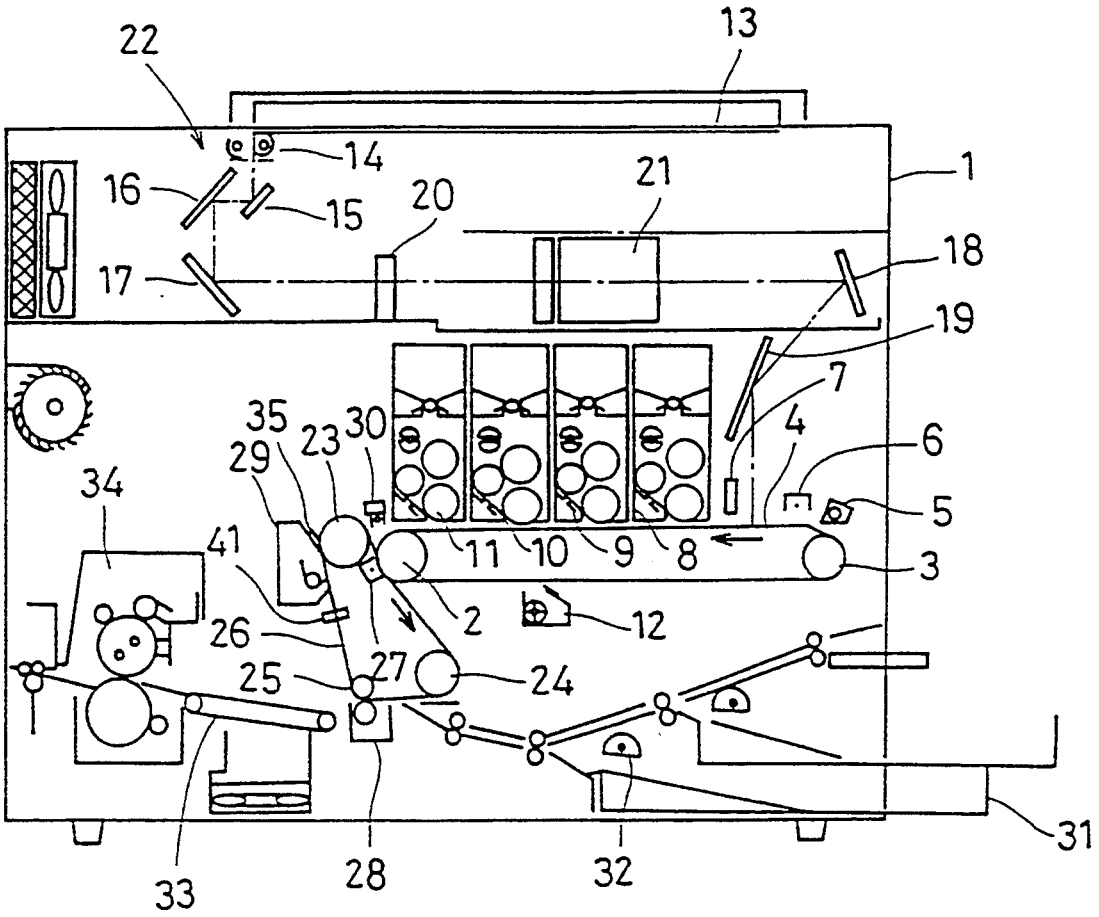
FIG. 4 is a diagram showing the construction of a full-color copying machine according to the present invention.

As shown in FIG. 4, the full-color copying machine of the present invention has a photosensitive material 4, a belt-like primary recording medium applied on a pair of driving rollers 2 and 3, and a discharger 5 and a charger 6, a blank lamp 7, developing units 8, 9, 10 and 11, and a primary cleaning unit 12. The developing units 8, 9, 10 and 11 are loaded with toners of yellow, magenta, cyan, and black, respectively.

A document table 13 is disposed on the upper surface of the copying machine 1. Beneath the document table 13, an optical system 22 is disposed which comprises a light source 14, mirrors 15, 16, 17, 18 and 19, a color separation filter 20, a lens 21, etc. The optical system 22 scans a document placed on the document table 13, and the light reflected therefrom is directed onto the portion of the photosensitive material 4 between the charger 6 and the blank lamp 7 to form an electrostatic image. The color separation filter 20 is switched over so as to transmit only the selected color blue, green, or red.

Adjacent to one of the driving rollers 2 of the photosensitive material 4 and in contacting relationship with the photosensitive material 4, there is disposed a belt-like secondary recording medium 26 which is applied on three rollers 23, 24 and 25 and onto which toner images of different colors are superposed one on top of the other. Disposed around the recording medium 26 are a transfer charge unit 27, a transfer unit 28, a secondary cleaning unit 29, and a secondary discharger 30.

In FIG. 4, the reference numeral 31 indicates a paper cassette, 32 a paper feed roller, 33 a suction belt, and 34 a fixing unit.

Figure 1:
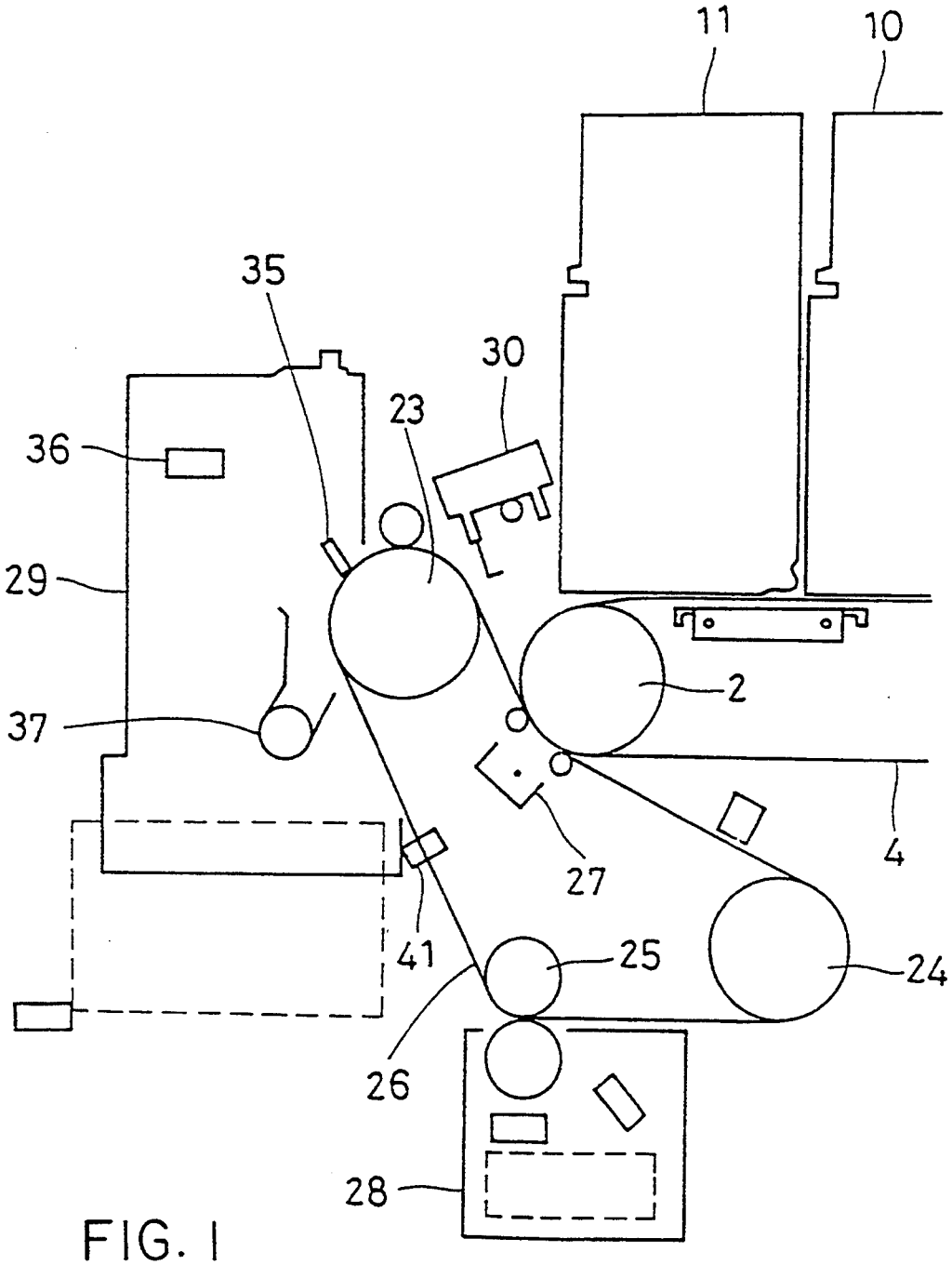
FIG. 1 is a diagram showing the construction of a cleaning unit in one example of the present invention.
Figure 2:
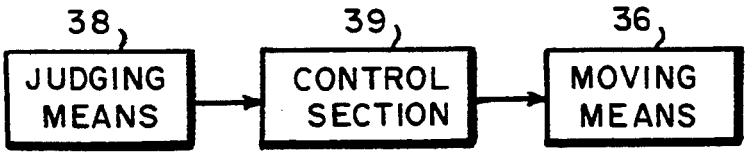
FIG. 2 is a control block diagram of the cleaning unit.

As shown in FIGS. 1 and 2, the secondary cleaning unit 29 comprises a cleaning head 35 for cleaning the surface of the recording medium 26, a moving means 36 for moving the cleaning head 35 to contact with and to separate from the recording medium 26, a toner collection roller 37 for carrying the toner removed from the recording medium 26 by the cleaning head 35 to a toner collection container (not shown), a judging means 38 for judging the preset image forming conditions such as the paper size, the document size, and the copy magnification ratio, and a control section 39 for controlling the timing to actuate the moving means 36 on the basis of the preset conditions judged by the judging means 38.

Figure 5:
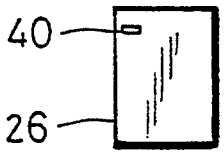
FIG. 5 is a plan view of a recording medium.

The recording medium 26 has a longer length than the A3 size, the maximum paper size used for copying. As shown in FIG. 5, an index hole 40 is provided in one side edge of the recording medium 26 as a reference for synchronizing the positioning of colors when superimposing a plurality of colors. An index sensor 41 for sensing the index hole 40 is disposed which comprises photointerrupters arranged facing each other with the recording medium 26 interposed therebetween. The sensor 41 senses the index hole 40 to synchronize the image forming system. To facilitate the synchronization of the image forming system, the leading edge of an image transferred to the recording medium 26 is always positioned with a predetermined space provided from the index hole 40.

The cleaning head 35 is a blade formed from an elastic material such as rubber. The moving means 36 consists of a solenoid for switching the cleaning head 35 between the contact position in which the cleaning head 35 contacts the recording medium 26 and the release position in which it is separated from the recording medium 26, and a tension spring (not shown) is provided to urge the cleaning head 35 away from the recording medium 26 so that the cleaning member 35 is put in the release position when the solenoid is deenergized.

The judging means 38 judges the image forming conditions on the basis of the output signals from the sensors, which detect the conditions of various parts of the copying machine, and the operations keys, such as a paper size detection sensor 42 for the paper cassette 31, a document size detection sensor 43 for the document table 13, a copy ratio key 44 for setting the copy magnification ratio, and a key 45 for selecting the toner color used for copying.

Figure 3:
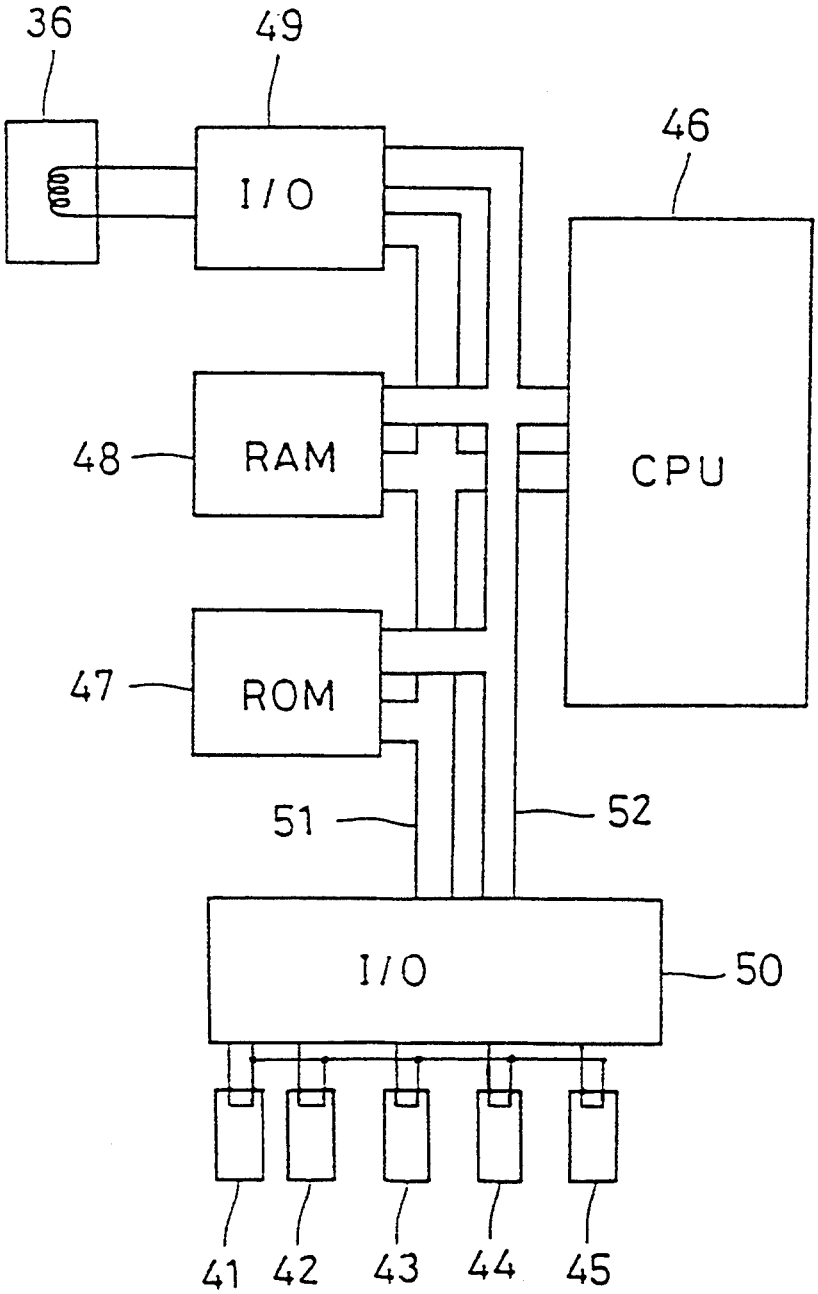
FIG. 3 is a block diagram of a control section.

The control section 39 consists of a single chip microcomputer in which, as shown in FIG. 3, a CPU 46, a ROM 47 that holds control methods and other data, a RAM 48 as a memory device for performing control, I/O ports 49 and 50 for turning on and off the motor, solenoid, and other loads, and for reading from the sensors that detect the conditions of various parts of the copying machine, are interconnected via an address bus 51 and a data bus 52, the entire copying machine being controlled by reading out the programs and values held in the ROM 47.

The solenoid 36 of the cleaning unit is connected to the output I/O port 49 via a driver, while the paper size detection sensor 42, the document size detection sensor 43, the copy ratio key 44, the color select key 45 and other keys, and the index sensor 41 are connected to the input I/O port 50.

The control section 39 has a function to perform control so that, after the detection signal has been input from the index sensor 41 on the basis of the output from the judging means 38, the solenoid 36 is energized to throw the cleaning head 35 into the contact position before reaching the front edge of the image area on the recording medium 26 corresponding to the selected paper size, and is deenergized to put it in the release position over the non-image area after passing the rear edge of the image area.

According to the above construction, a document placed on the document table 13 is scanned by the optical system 22, and only the blue light is transmitted through the color separation filter 20 to expose the photosensitive material 4. As a result, a latent image having blue color information is formed on the photosensitive material 4, and a yellow toner image is formed thereon by means of the developing unit 8 loaded with yellow toner.

The toner image is transferred onto the recording medium 26 by means of the transfer charge unit 27, the leading edge of the toner image being positioned on the recording medium 26 with a predetermined space provided from the index hole 40.

The optical system 22 scans the document for the second time, forming a latent image having green color information on the photosensitive material 4 in the same manner as above, and magenta toner is made to adhere to the latent image to form a magenta toner image. Then, the toner image is transferred onto the recording medium 26 in such a way as to be superimposed on top of the yellow toner formed in the preceding cycle.

Likewise, cyan toner is made to adhere to a latent image having red color information to form a cyan toner image, which is then superimposed on top of the yellow/magenta combined toner image.

Thereafter, the toner image composed of the three colors is transferred by means of the transfer unit 28 onto the copy paper fed from the paper cassette 31, and the transferred image is fixed by means of the fixing unit 34 and is discharged from the copying machine, thus producing a full-color image copy.

Figure 6:
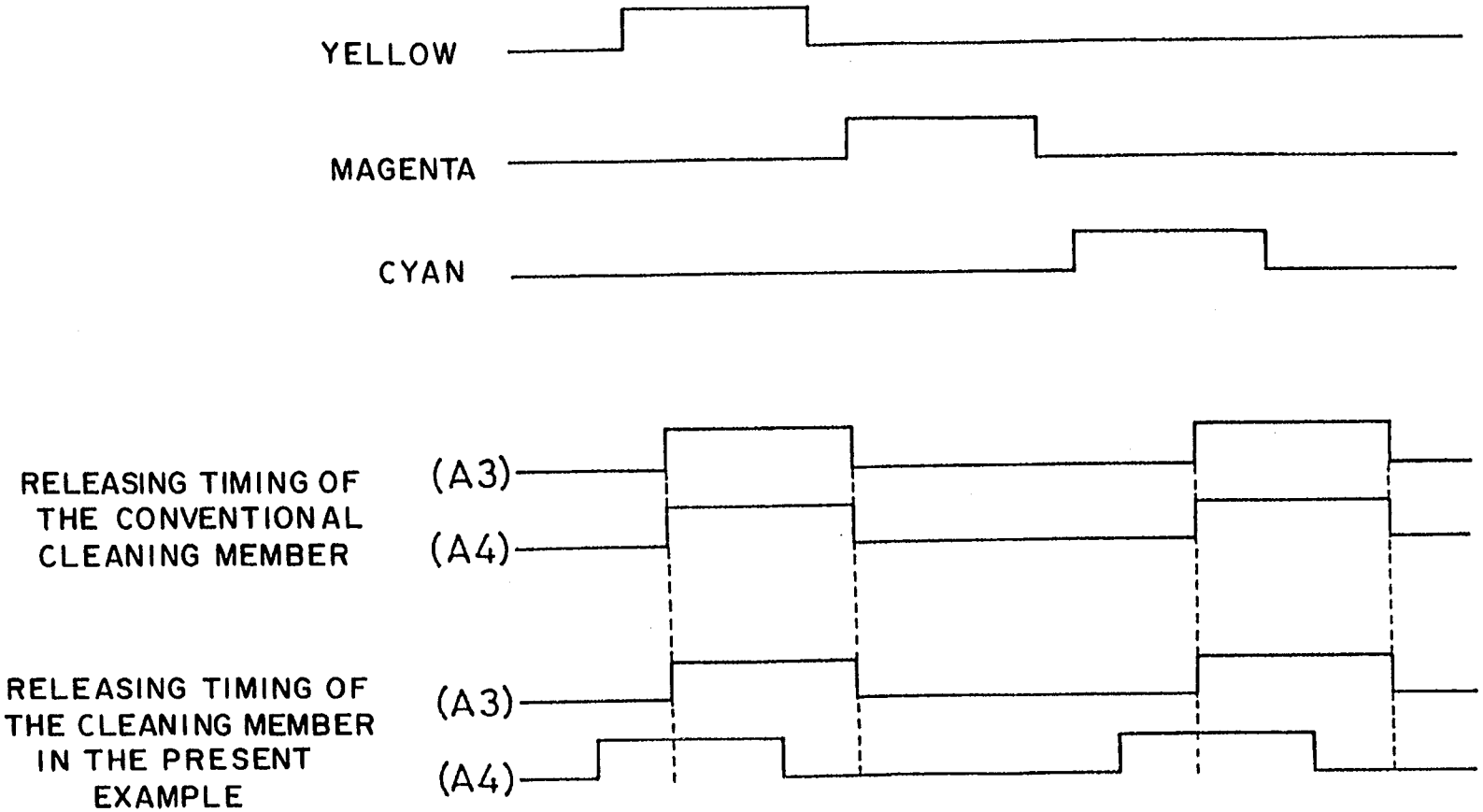
FIG. 6 is a timing chart for developing and cleaning operations.

In the secondary cleaning unit 29, while the image is being developed on the photosensitive material 4 using the yellow toner, as shown in FIG. 6, the unit 35 on the recording medium 26 to preclean the recording medium 26 to remove the toner remaining from the preceding copy cycle. After the precleaning is completed, the toner images are superimposed one on top of the other onto the recording medium 26 in the sequence of yellow, magenta, and cyan. While this is happening, the cleaning head 35 rests in a position separated from the recording medium 26 with the solenoid 36 deenergized, so as not to scrape off the toner images being superimposed.

At this time, when the cleaning head 35 is released, the toner adhering to the cleaning head 35 is caused to fall off the cleaning head 35 by the impact of the releasing action, and is deposited as dirt onto the recording medium 26. When the falling toner adheres to a non-image area on the recording medium 26, this does not result in smearing the copy image as the deposited toner is not transferred to the copy paper, but when the toner adheres to an image area, the deposited toner is transferred to the copy paper together with the document image, thus resulting in smearing the copy image.

In a prior art method for controlling the cleaning head 35, the pressing and separation of the cleaning head 35 have been performed at the same position on the recording medium 26. As a result, in the case of copying to an A4 size paper, for example, although a non-image area A takes up more than half the surface of the recording medium 26 as shown in FIG. 8(*b*), the cleaning head 35 is separated at a position very close to the front edge of an image area B. As a result, when the toner adhering to the cleaning head 35 falls off, the toner is more likely to fall onto the image area B, thus leading to the smearing of the copy image.

In the present example, on the other hand, when the copy size is A4, the cleaning head 35 is released, as shown in FIG. 7(*b*), at a non-image area A on the recording medium 26 as close as possible to the rear edge of an image area B that corresponds to the A4 image area. When the toner falls off the cleaning head 35, since the belt is rotating, the toner flies into the non-image area A away from the image area B. Therefore, the flying toner falls onto the non-image area A, and is not transferred as smears onto the copy paper.

In the case of an A3 copy paper, since only a small area is left on the recording medium 26 for the non-image area A, the cleaning head 35 is pressed and separated at the same timing as in the prior art method.

As described above, since the release timing of the cleaning head 35 is changed according to the paper size, even if the toner falls off the cleaning head 35 at the time of the releasing action, the toner adheres to the non-image area A on the recording medium 26, so that the smearing of the copy image on the copy paper can be prevented and adverse effects on the copy image by the flying toner can be avoided.

In this example, the release timing of the cleaning head 35 is changed according to the paper size, but alternatively, the release timing of the cleaning head 35 may be determined by the document size and magnification ratio.

Also, in the case of a copying machine in which the timing to feed the paper to the transfer section is changed to perform centering and other copy processes when transferring the toner image from the recording medium 26 to the copy paper, the release timing of the cleaning head 35 may be changed by judging the centering and other modes.

The cleaning unit of the present invention may also be applied to mono-color or two-color copying machines other than full-color copying machines, or to laser printers. It can also be applied to the cleaning unit for a photosensitive material.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A cleaning unit used in an image forming apparatus, said image forming apparatus successively forming at least one toner image on a photosensitive material, said at least one toner image being successively transferred to a recording medium to form an image thereon, said image formed on said recording medium being transferred to a paper, any residual toner on said recording medium being removed by said cleaning unit after said image is transferred to said paper, said cleaning unit comprising:

a cleaning head for removing said residual toner while being in contact with said recording medium;

moving means for moving said cleaning head in contact with said recording medium and for separating said cleaning head from said recording medium;

judging means for judging preset image forming conditions; and control means for controlling said moving means to separate said cleaning head from said recording medium immediately after a rear edge of said image formed on said recording medium passes through said cleaning head, on the basis of the judgment of said judging means.

2. A cleaning unit according to claim 1, wherein said preset image forming conditions include a size of said paper.

3. A cleaning unit according to claim 2, wherein said preset image forming conditions further include copying magnification.

4. A cleaning unit according to claim 1, wherein said recording medium is provided with an index, and a leading edge of said image formed on said recording medium is positioned with a predetermined space from said index.

5. A cleaning unit according to claim 4, wherein said rear edge of said image formed on said recording medium is positioned depending on said preset image forming conditions.

6. A cleaning unit for use in an image forming apparatus, said image forming apparatus successively forming at least one toner image on a photosensitive material, said at least one toner image being successively transferred to a recording medium to form an image thereon, said image formed on said recording medium being transferred to a paper, and any residual toner on said recording medium being removed by said cleaning unit after said image is transferred to said paper, said cleaning unit comprising:

a cleaning head for removing said residual toner while being in contact with said recording medium;

moving means for separating said cleaning head from said recording medium and for bringing said cleaning head in contact with said recording medium;

judging means for judging preset image forming conditions; and control means for controlling said moving means to move said cleaning head on a judgment of said judging means, wherein said moving means keeps said cleaning head in contact with said recording medium only for a predetermined period, the predetermined period being substantially equal to a period required for one rotation of said recording medium irrespective of the judgment of said judging means, and wherein said moving means is controlled to separate said cleaning head from said recording medium immediately after a rear edge of said image formed on said recording medium passes through said cleaning head, on the basis of said judgment of said judging means.

* * * * *